United States Patent [19]

Clark et al.

[11] Patent Number: 4,522,299

[45] Date of Patent: Jun. 11, 1985

[54] RIGID POLYETHYLENE CARRY GOLF BAG WITH STAND

[75] Inventors: George W. Clark; Christopher B. Keene, both of Orono, Canada

[73] Assignee: 434743 Ontario Inc., Orono, Canada

[21] Appl. No.: 573,291

[22] Filed: Jan. 23, 1984

[51] Int. Cl.[3] ..... A63B 55/00; B62B 1/04

[52] U.S. Cl. ..... 206/315.3; 206/315.4; 206/315.6; 206/315.7; 248/96; 280/646; 280/DIG. 6

[58] Field of Search ..... 206/315.2, 315.3, 315.4, 206/315.6, 315.7, 315.8; 190/18 A, 115; 280/DIG. 6, 47.17, 47.19, 646; 248/96; 211/60 G, 70.2; 16/110 R, 115

[56] References Cited

U.S. PATENT DOCUMENTS

| | | | |
|---|---|---|---|
| 646,869 | 4/1900 | Perkes | 206/315.2 |
| 1,924,182 | 8/1933 | Fritz | 206/315.7 X |
| 2,538,374 | 1/1951 | May | 280/DIG. 6 X |
| 2,577,290 | 12/1951 | Underwood | 280/DIG. 6 X |
| 2,602,676 | 7/1952 | Fieldhouse | 280/DIG. 6 X |
| 2,783,054 | 2/1957 | Stratton, Jr. | 280/DIG. 6 X |
| 3,081,108 | 3/1963 | Vogt | 280/DIG. 6 X |
| 3,164,185 | 1/1965 | Ingoldt | 206/315.6 X |
| 3,371,898 | 3/1968 | Murray, Jr. | 206/315.3 X |
| 3,530,919 | 9/1970 | May | 206/315.4 |
| 3,559,709 | 2/1971 | Siebold | 206/315.8 |
| 3,779,297 | 12/1973 | Stammer | 206/315.6 |
| 3,842,876 | 10/1974 | Cristelli | 206/315.4 |
| 3,941,398 | 3/1976 | Nelson | 206/315.6 X |
| 3,980,115 | 9/1976 | Longo | 206/315.6 |
| 3,985,229 | 10/1976 | Maki | 206/315.6 |
| 4,142,563 | 3/1979 | Ackerfeldt et al. | 206/315.6 X |
| 4,143,694 | 3/1979 | Gregory | 206/315.2 X |
| 4,194,547 | 3/1980 | Sidor et al. | 206/315.6 |
| 4,262,928 | 4/1981 | Leitzel | 280/DIG. 6 X |
| 4,340,102 | 7/1982 | Isabel | 206/315.6 |
| 4,340,236 | 7/1982 | Siebold et al. | 280/DIG. 6 X |

FOREIGN PATENT DOCUMENTS

| | | | |
|---|---|---|---|
| 2020185 | 11/1979 | United Kingdom | 280/DIG. 6 |

*Primary Examiner*—William Price
*Assistant Examiner*—Sue A. Weaver
*Attorney, Agent, or Firm*—George A. Rolston

[57] ABSTRACT

A golf club bag having, an integral outer shell, a top panel closing the upper end of the shell, with shaft apertures therein, a core within the shell, stops at the lower end of the core, guide channels in the core forming handle recesses, a handle on the exterior of the shell, and, releasable closure for the upper end of the shell.

5 Claims, 13 Drawing Figures

Fig 9
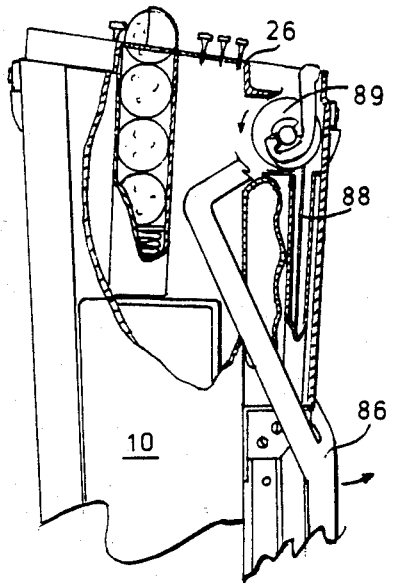
Fig 8
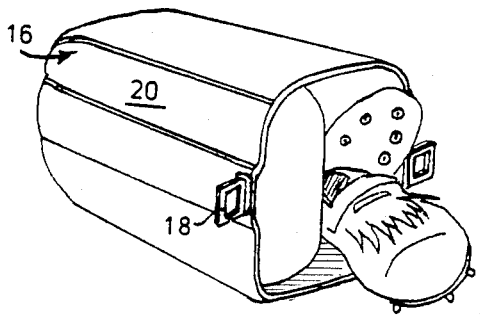
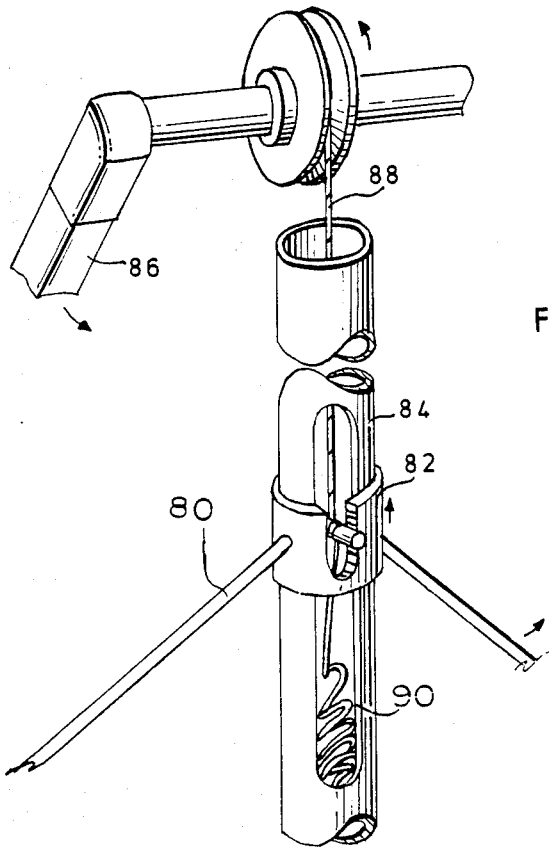
Fig 10

RIGID POLYETHYLENE CARRY GOLF BAG WITH STAND

The invention relates to a rigid bag for golf clubs and in particular to a bag which can be used for carrying the clubs from place to place in a secure manner, and which can also be used on the golf course, as a wheeled bag or cart.

BACKGROUND OF THE INVENTION

The conventional golf club bag is made of flexible fabric and is generally unsuitable for use in transporting the golf clubs safely from place to place. There are also some problems in use on the golf course itself. The selection of any particular club from the bag often involves disentangling the handles of the clubs. Similarly, the return of a club to the bag is often inconvenient, and may result in scratching the handles of the clubs.

When the clubs are used in wet weather, water may accumulate on the clubs, and may drain into the bottom of the bag, or be transformed onto the other clubs. In addition, clubs stored after usage are likely to suffer damage from dampness.

Proposals have been made in the past for the design of a more rigid bag, providing greater protection for the clubs. In addition, the use of tubular sheaths for club handles is well-known.

One such proposal is shown in U.S. Pat. No. 3,559,709. The design of the bag shown in that patent is relatively cumbersome and clumsy, and while providing adequate protection for the clubs during transit or shipment, fails to satisfactorily solve the other problems. It is excessively complex to design and build and involves the fabrication of a relatively large number of different component parts which must then be fastened together.

It is, therefore, a general objective of the invention to provide a rigid golf bag for golf clubs which provides adequate control over the shafts of the clubs, while providing for relatively free circulation of air, and which provides for removal of water, and which is adaptable for use in shipping and in transit of the clubs, and is also readily available for use as a golf cart on the golf course, and which may be fabricated out of a smaller number of components, providing greater strength and utility in the end product at a more economical price, and with less material and, therefore, less weight.

BRIEF SUMMARY OF THE INVENTION

With a view to overcoming these various disadvantages, and providing a golf club bag meeting these general objectives, the invention comprises an integral one-piece tubular outer shell, having a closed bottom end, and an open top end, a top panel closing said open upper end of said tubular shell, and having a plurality of shaft apertures therein, a core having panels extending from said upper end downwardly and stops at the lower end of the core for supporting the ends of the club handles, terminating short of the closed end of said tubular shell, handle means on the exterior of said tubular shell, and releasable closure means for said upper end of said tubular shell dimensioned and shaped to cover the heads of clubs located in said tubular shell. In a preferred form a wheeled support is attached to said shell, and is extendable therefrom for supporting the shell in a generally upright position.

More particularly, the invention provides a bag having the foregoing advantages including wheels on said shell, and a movable arm on an upper portion of said shell linked to the wheel support and being extendable therefrom, whereby said bag may be used as a wheelable cart on a golf course.

More particularly, the invention provides a golf bag having the foregoing advantages wherein a carrying handle is formed integrally in one piece with such tubular shell.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described preferred embodiments of the invention.

IN THE DRAWINGS

FIG. 8 is a perspective of the top;

FIG. 9 is a side elevation of the handle mechanism partly cut away;

FIG. 10 is a detail of the linkage;

DESCRIPTION OF A SPECIFIC EMBODIMENT

Figure 1:
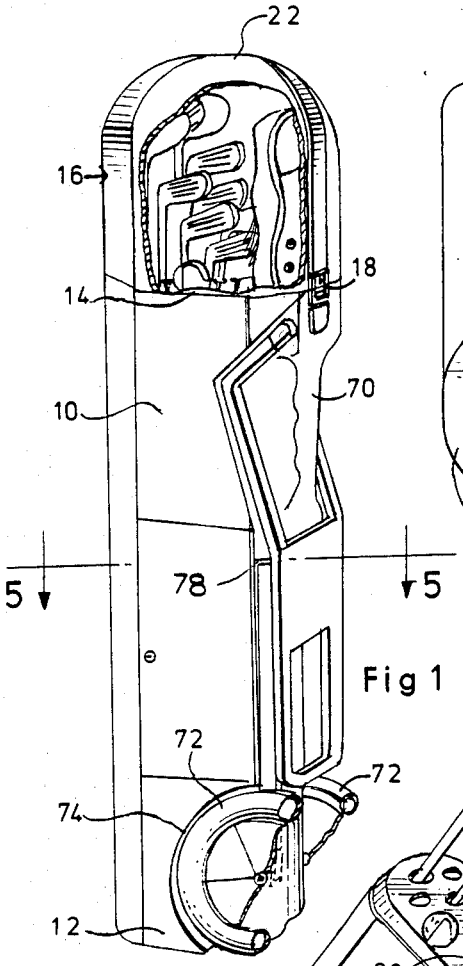
FIG. 1 is a perspective illustration of a golf bag according to the invention.
Figure 3:
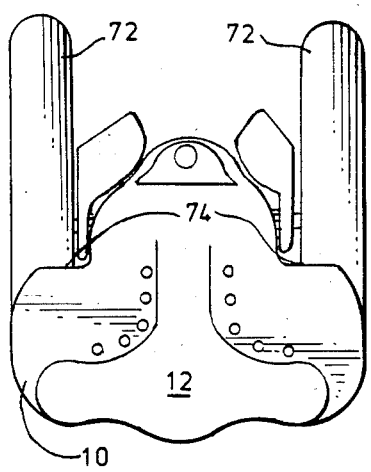
FIG. 3 is a bottom plan view.
Figure 2:
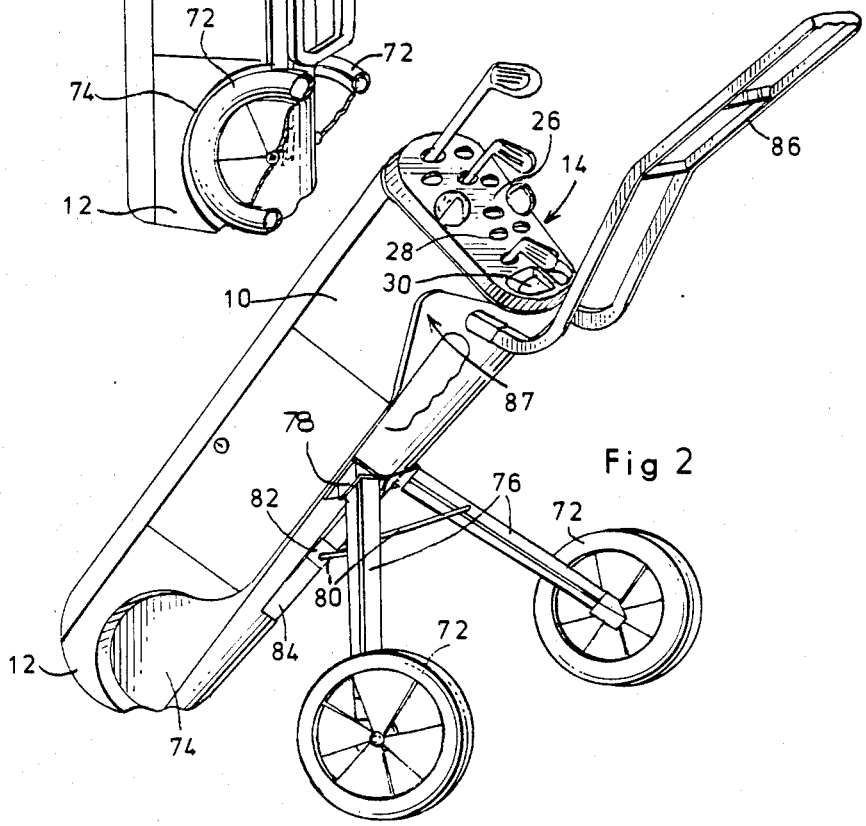
FIG. 2 is a perspective showing the wheels and handle extended.
Figure 4:
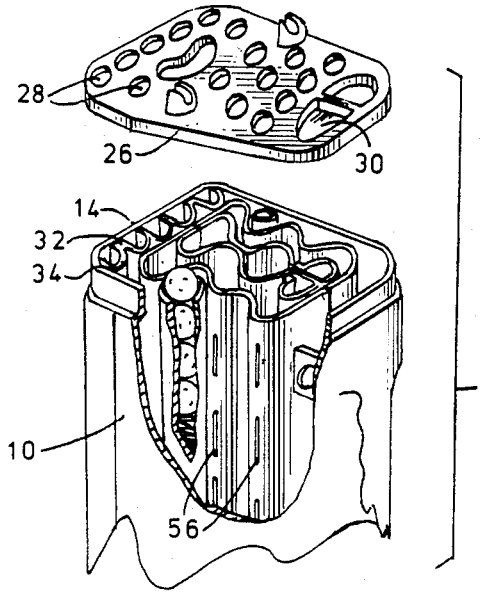
FIG. 4 is an exploded perspective of an upper portion of the bag, shown cut away to show the core.
Figure 5:
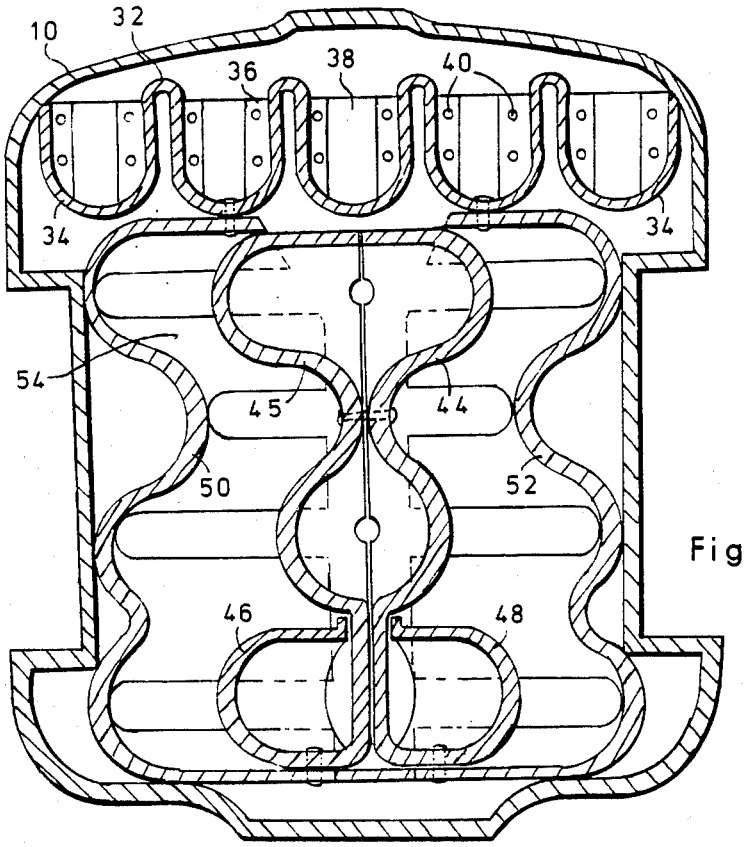
FIG. 5 is a section along 5—5 of the core.
Figure 6:
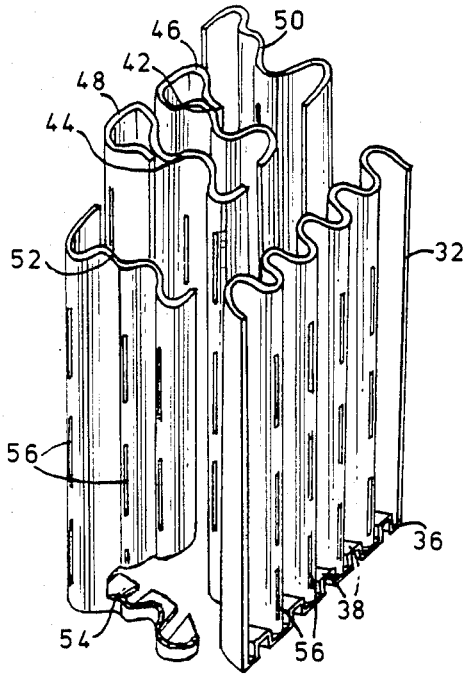
FIG. 6 is an exploded perspective of the inner core.
Figure 7:
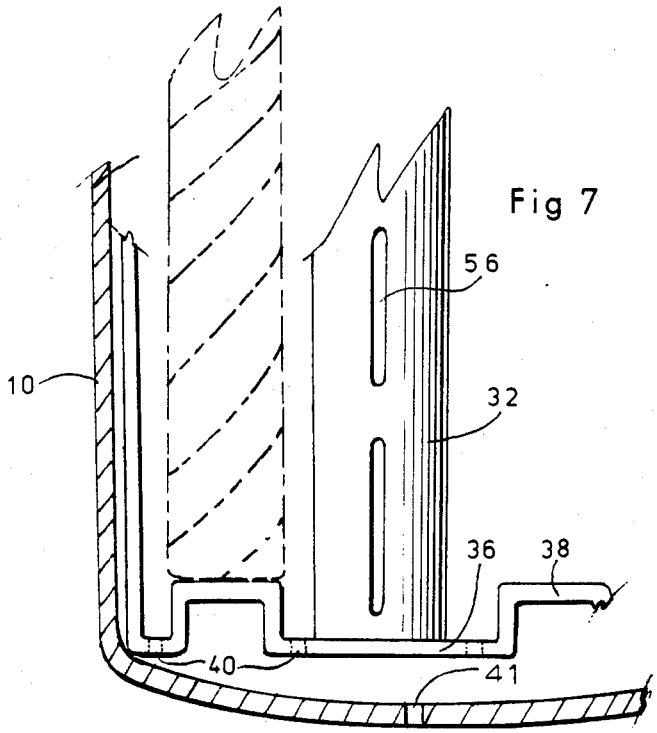
FIG. 7 is an elevation of a bottom portion of the core with the shell in section.

Referring generally to FIGS. 1, 2 and 3, the invention will be seen to comprise a golf bag, for carrying clubs, golf balls, tees, and other golfing accessories. Provision may also be made in the bag for carrying certain items of golf clothing such as shoes, gloves, jackets, and any other articles of golf clothing which may be desired from time to time.

The golf bag, according to the invention, comprises a rigid outer tubular shell indicated generally as 10, having a closed lower end 12, and an open upper end indicated generally as 14.

A rigid enclosure or end cap 16 is movably attachable to the shell 10 at its upper end 14, by means typically of two latches 18. The latches 18 are capable of being disengaged or dismantled so that the end closure cap can simply be removed altogether during use on the golf course. The closure or cap 16 is formed with a generally tubular shell 20, of a shape and dimension and cross section corresponding to that of the tubular body or shell 10. Cap 16 has a closed end 22 at its upper end.

Typically, the closure or cap will be dimensioned to define a cavity at least sufficient to receive and enclose the heads of the golf clubs which extend upwardly from the upper end of the tubular shell 10. The end cap may, of course, be made somewhat longer, so as to provide accommodation or storage space for other articles.

The latches 18 provide means whereby it may be fastened in the closed position, and may incorporate locks where desired for the sake of security.

The open upper end 14 of the tubular shell 10 is provided with a top panel 26, which is suitably fastened in position, and is formed with a plurality of apertures 28, each of which is intended to receive the shaft of a single individual golf club. Typically, the top panel 26 may be formed by moulding techniques, for example, injection moulding, and suitable markings may be moulded into the upper surface of the panel, indicated generally as 30, indicating which club is intended to be received in each aperture.

The interior of the hollow shell 10 is divided up into separate compartments for the various clubs by means of partition panels, in this case five panels, which are fitted and fastened together to form a unitary core, which is then inserted into the hollow shell 10.

Such partition panels comprise a first vertically corrugated partition panel 32 having generally U-shaped lengthwise corrugations 34. A lower support flange 36 extends from side to side at the lower end, and has ridges 38 and drain openings 40 registering with corrugations 34. An outer drain hole 41 is also provided in tubular shell 10. Second and third panels 42 and 44 are similar to each other but are formed right hand and left hand. They are generally corrugated but with the end corrugation being rotated 180° and closing off two vertical channels 46 and 48.

These two panels 42 and 44 are fastened to each other with rivets and are in turn held at right angles the first panel 32.

Fourth and fifth panels 50 and 52 are again generally corrugated vertically and are formed left hand for one and right hand for the other. They are in turn fastened to both panel 32 and to respective panels 42,44.

Panels 42,44 and 50,52 are all provided at their lower ends with flanges 54.

A total of 18 sleeve-like recesses are thus formed by the corrugations, to correspond with the apertures formed in the top panel 26.

As noted above, the five partition panels, when fastened together, form an integral core which is inserted into the shell. As will be noted, however, the partition panels terminate above closed lower end 12 of the shell, so as to leave a free air space in this region for free circulation of air. Openings such as 56 are formed to further promote the free circulation of air, through the panels.

It will also be appreciated that it is not necessary for the corrugations on the corrugated partition panels to actually come into contact with each adjacent panel and indeed a moderate airspacing is desirable to still further promote the free flow of air.

In addition, the ridges 38 formed in the lower flanges 36 are designed to act as stand offs for the golf club shaft ends. This aids in keeping dirt and moisture content to a minimum.

The spacing between the shell, and the unitary core walls is utilized in various ways for storage of various golfing accessories, articles of clothing, and the like.

In order to permit the bag to be carried by hand, a handle 70 may be formed in a side wall of the shell 10. Typically, in this embodiment the shell 10 is a single integral homogenous moulding, typically being formed by blow moulding techniques from thermoplastic material. Such a handle may thus readily be formed in such moulding techniques as an integral part of the shell.

In order that the bag may also be used on the golf course as a golf cart, two wheels 72 are provided. The wheels 72 are located in suitable recesses or wheel wells 74, formed in the lower end of the bag shell 10.

Such wheels are suitably mounted on bipod legs 76. Legs 76 are hinged at 78 and can be swung to permit the bag to be pulled along in a manner of a cart.

Bracing struts 80 are provided for legs 76 for holding legs 76 in their outer position. A slide 82 is located on rib 84 and secures the inner ends of the struts 80 and permits them to extend outwardly. In this way the bag may be stood upright. In this sense, the term upright does not indicate a precisely perpendicular position, but a position at an upwardly directed angle, convenient for a player reaching for a club.

In order to assist the golfer in pulling the bag along on its wheels, an extendable handle is provided which is indicated generally as 86. The handle 86 is a pivoted member and may be pivoted inwardly into a recess 87 in the bag for storage when not in use (FIGS. 1, 2).

An operating cable 88 (FIGS. 9, 10) extends between pulley 89 on handle 86 and slide 82. When handle 86 is swung open slide 82 is drawn upwardly. Struts 80 then force legs 76 to swing out for use. When handle 86 is swung closed, legs 76 are retracted and held locked by spring 90.

It will be appreciated that the bag may thus be used both closed and locked for shipment of the clubs, and accessories, clothing and the like, as a single article of luggage. When in use, with the pulling arm extended, and the wheels extended, the device may be pulled along the course, and used as a golf cart.

Figure 12:
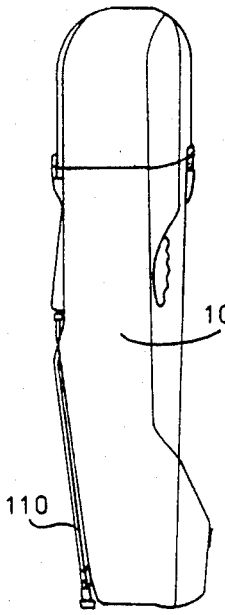
FIG. 12 is a side elevation of the FIG. 11 embodiment.
Figure 11:
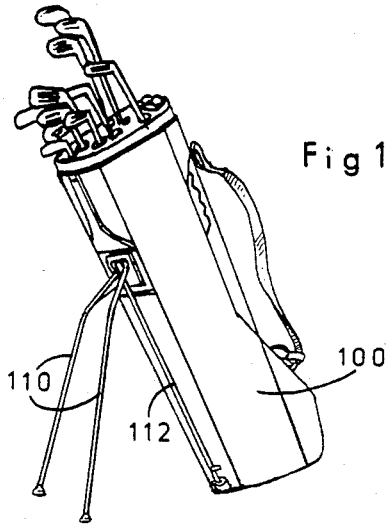
FIG. 11 is a perspective of an alternate embodiment.
Figure 13:
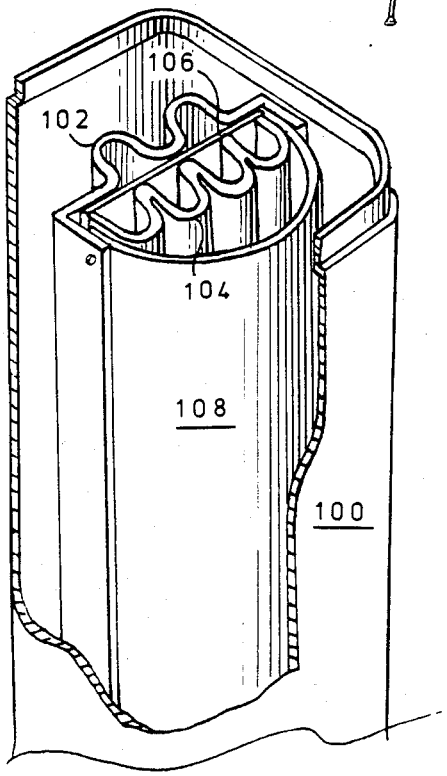
FIG. 13 is a cut away perspective showing the core of FIG. 11.

An alternate form of bag is shown in FIGS. 11, 12 and 13.

A shell 100 has a core formed of corrugated walls 102, 104, and smooth walls 106, 108. Wall 108 is curved and provides a space between it and wall 104 for some of the club handles. A space between wall 102 and shell 100 accomodates other handles.

There are no wheels on this form of bag.

Instead, a pair of support legs 110 are hinged to shell 100, and may be held extended by a spring link 112. Clips (not shown) secure legs 110 in the stored position.

All of these different modes of usage combined in a structure which provides safety and security for the set of clubs during shipment and transportation, and at the same time provides an attractive piece of luggage. Similarly, the bag when in use on the golf course, is complete in itself and does not require the addition of various other accessories as was the case in the past.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A golf club bag comprising:

an integral one-piece tubular outer shell, having a closed bottom end, and an open upper end;

a top panel closing said open upper end of said tubular shell, and having a plurality of shaft apertures therein;

a core defining guide channels forming handle recesses for reception of club handles therein fastened within said shell and extending from said upper end of said shell downwardly and terminating short of the closed end of said shell;

stops at the lower end of said channels for supporting the ends of club handles;

handle means on the exterior of said tubular shell;

releasable closure means for said upper end of said tubular shell dimensioned and shaped to cover the heads of clubs located in said tubular shell;

a pair of movable legs swingably mounted on said outer shell;

spring means normally biassing said legs into a closed position;

linkage means extending between said handle means and said legs whereby said legs may be moved against said spring, into an extended position;

struts linked at one end to said legs, and, slide means, and a guide for said slide means on said shell, said struts being connected at their other ends to said slide means.

2. A golf club bag as claimed in claim 1 including wheels attached to said legs for supporting the shell in a generally upright position.

3. A golf club bag as claimed in claim 2 wherein said handle means includes a movable arm on an upper portion of said shell linked to said legs and being extendable therefrom, whereby said bag may be used as a wheelable cart on a golf course.

4. A golf club bag as claimed in claim 1 wherein said core comprises panels of moldable material having corrugations extending therein forming said handle recesses.

5. A golf club bag as claimed in claim 4 including apertures formed in said panels, and drain holes formed in said stops, and drain holes formed in the lower end of said shell.

* * * * *